US006004075A

United States Patent [19]

Haas

[11] Patent Number: 6,004,075

[45] Date of Patent: Dec. 21, 1999

[54] MUDMATS FOR OFFSHORE PLATFORM SUPPORT

[75] Inventor: Mark E. Haas, Houston, Tex.

[73] Assignee: Stuck In The Mud, L.P., Houston, Tex.

[21] Appl. No.: 09/027,239

[22] Filed: Feb. 20, 1998

[51] Int. Cl.[6] ..... E02B 17/02

[52] U.S. Cl. ..... 405/224; 405/226; 405/195.1

[58] Field of Search ..... 405/195.1, 203, 405/201, 207, 211, 211.1, 224, 226, 227, 228, 274

[56] References Cited

U.S. PATENT DOCUMENTS

| | | | |
|---|---|---|---|
| 2,995,900 | 8/1961 | Hunsucker | 405/224 |
| 3,064,437 | 11/1962 | Knapp | 405/224 |
| 4,307,977 | 12/1981 | Haney . | |
| 4,720,214 | 1/1988 | Brasted et al. . | |
| 4,863,315 | 9/1989 | Wickberg | 405/274 |
| 5,333,971 | 8/1994 | Lewis | 405/274 |

*Primary Examiner*—David Bagnell
*Assistant Examiner*—Frederick L. Lagman
*Attorney, Agent, or Firm*—Bracewell & Patterson

[57] ABSTRACT

A mudmat in which the bearing plates of the mudmat are fabricated of a non-corrosive, man-made structural material such as plastic. The plates, formed of such a material, are lightweight, easily fabricated and generally less expensive than the prior art plates and their associated support structure. In one preferred embodiment, the plates are formed of extruded polyvinyl chloride (PVC) or a fiber reinforced composite such as thermoset resin reinforced with glass fibers (GRP). The individual plates are supported by standard frame members. The PVC or GRP plates are of such a size, shape and weight that they can easily be transported to, assembled and attached to the offshore jacket at the jacket fabrication site. Being formed of such materials, the plates are corrosion resistant, eliminating the need for cathodic protection. In addition, the PVC or GRP plates are much lighter in weight than the wood or metal plates of the prior art, such that they have much less impact on the buoyancy and weight of the jackets to which they are attached. In one preferred embodiment, the plates may be corrugated to enhance resistance to horizontal and vertical displacement forces placed on the offshore jacket.

12 Claims, 3 Drawing Sheets

MUDMATS FOR OFFSHORE PLATFORM SUPPORT

BACKGROUND OF INVENTION

1. Field of Invention

The invention relates to an apparatus for temporarily supporting an offshore platform substructure or jacket on soft, unconsolidated ocean floors, and more particularly to a mudmat that is lightweight and corrosion resistant.

2. Description of the Prior Art

Currently, much of the hydrocarbons produced from the earth are extracted from beneath the ocean floor. Various types of structures have been employed in these offshore extraction operations. Typically, the structures consist of a horizontal working platform or equipment deck which is supported above the water's surface by a substructure, commonly referred to as an offshore jacket. Offshore jackets are most often fabricated onshore, towed or transported by barge to the drilling site, and lowered to the proper position on the sea floor.

Generally, an offshore jacket is comprised of at least three substantially vertical legs that are interconnected by framing or cross-bracing members to form a triangular or rectangular base, wherein a leg is disposed at each corner of the base. In its upright position, the jacket rest on the sea floor with the bottom of the legs resting on the sea floor or slightly penetrating into the soil. The jacket is secured to the sea floor with piles which are either driven through the legs or driven through sleeves attached to the legs.

In many areas of the world, the soil of the sea floor is unconsolidated and very soft resulting in very low allowable bearing pressures. These soft sea floors occur frequently near the mouths of large rivers that empty into the oceans. Sea beds in the world which exhibit high hydrocarbon content but are characterized by soft soils from river deltas include areas in the Gulf of Mexico, west Africa and southeast Asia.

The low bearing pressures of these unconsolidated sea floors create jacket support problems during installation of offshore platforms. Specifically, without adequate support, the legs of a jacket will sink into the sea floor, causing the jacket to either fall onto its side or settle lower than design specifications. In any case, jacket settling due to a soft sea floor can negatively effect the alignment of the jacket as it is positioned at the drilling site. In this same vein, difficulties often arise during pile driving operations, which are generally completed within one to two weeks of placing a jacket in position on the sea floor. As a pile is driven into the sea bed through a sleeve, the leg or portion of the jacket to which the sleeve is attached tends to sink into the soft mud under forces applied during the pile driving operation, thus effecting the overall alignment of the jacket.

One solution to the difficulties associated with unconsolidated sea floors is to provide a structure that spreads the downward forces applied to the jacket over a larger area of the sea floor. The most common structure for accomplishing this task is called a mudmat. A mudmat has a very large surface area that rests against the sea floor (as opposed to the comparatively small surface area of a jacket leg), distributing the load of the jacket over a larger sea floor, thus allowing the jacket to properly stand on the soft sea floor and to provide stability during pile-driving operations.

Mudmats are typically comprised of framing members which are attached to and provide support to a bearing plate. The bearing plate rests against the sea floor and provides the large surface area for force distribution. The mudmats themselves are attached to the bottom of a jacket, most often adjacent the legs of the jacket. Originally, bearing plates were fabricated from wood timbers with large amounts of steel support structure to back the bearing plates. These "wooden mudmats", however, are characterized by a number of drawbacks. The large, long timbers most suitable in fabricating such mudmats are often difficult to obtain and comparatively expensive. Such mudmats also require substantial amounts of man-hours to assemble and require large mounts of steel to provide the necessary backing support structure. Finally, although wooden mudmats provide some buoyancy in water, approximately 5–10 pounds per square foot, such mudmats are comparatively heavy in air, weighing approximately 30–40 pounds per square foot. The bulky nature of these prior art mudmats, i.e., large surface areas combined with comparatively large weights, render such mudmats difficult to manipulate and install.

One solution to the drawbacks associated with wooden mudmats has been to fabricate mudmat bearing plates out of stiffened steel plates, corrugated steel plates or steel sheet piles. These "steel mudmats" offer a number of improvements over wooden mudmats. Steel mudmats require less backing support structure than wooden mudmats. In addition, steel mudmats typically weigh less than wooden mudmats. Specifically, steel mudmats typically weigh in air approximately 22–30 pounds per square foot. However, steel mudmats have their own drawbacks. Steel mudmats are themselves comparatively heavy and are characterized by high fabrication costs. More significantly, steel mudmats are subject to high corrosion rates unless protected in some manner.

The functional life of mudmats is approximately the one to two weeks required for the pile-driving operations to be completed. After the installation of the piles, the mudmats become functionally useless for the remaining life of the offshore platform. However, offshore platforms are designed for a functional life of typically 10, 20, or 30 years, depending upon the development of the oil and gas field. Though the mudmats are functionally useless, steel mudmats are parasitic in nature in that they contribute to the drain of the cathodic protection that is provided for offshore platforms.

The cathodic protection is necessary to prevent oxidation and corrosion of the offshore platform and to prevent the subsequent reduction in its structural integrity. Aluminum-alloy ingots typically serve as the sacrificial anodes to protect the offshore platform. Since steel mudmats are generally attached to a jacket by welding to become part of the jacket structure, the mudmats are electrically connected to the offshore platform and contribute to the drain of the sacrificial anodes.

One solution to the problem of cathodic drain by the mudmats is to remove the mudmats from the jacket structure after pile-driving is complete. Typically, mudmat removal includes the use of divers who must be sent to the sea floor to cut the mudmats from the jacket. In addition, since the mudmats are generally bounded by permanent framing structure, the mudmats are extremely difficult to remove in one piece, and thus must be cut into smaller pieces that can be maneuvered around the permanent framing structure and lifted to the surface. This procedure is repeated over and over again for every piece of the mudmat until all pieces have been removed. Although effective, mudmat removal is undesirable because the procedure is costly and time consuming. Thus, there remains a need for mudmats that do not present a drain on the cathodic protection provided for the offshore platform itself, nor require removal following their useful life.

Turning back to the weights of both wooden and steel mudmats, offshore jackets are typically designed to have small amounts of reserve buoyancy, approximately 7–12% of the weight of the jacket, to permit ease in lifting, manipulation and positioning. The addition of heavy wooden or steel mudmats at the base of a jacket can negate this buoyancy and the beneficial effects realized by the buoyancy. To counter the weight of the mudmats, therefore, additional buoyancy must then be added to the top portions of the jacket. This is generally accomplished by providing larger diameter members for the legs and framing members. In so doing, however, not only is the overall cost of the jacket increased, but the susceptibility of the jacket to external wave forces is also increased. In other words, because of the small amounts of reserve buoyancy, offshore jackets are generally very sensitive to weight and buoyancy forces. As larger diameter members are incorporated into the structure, this sensitive balance is disrupted. Specifically, the larger diameter members provide a greater surface area against which ocean currents and waves can act. Not only can this require additional bracing to withstand these lateral forces, it can result in the need for enhanced pile support through either the addition of more piles or an increase in the depth to which piles are driven into the sea floor.

For the forgoing reasons, there remains a need for mudmats that will not adversely effect the weight and buoyancy of an offshore jacket to the degree of the prior art mudmats. The mudmats should avoid the need for cathodic protection or removal. In addition, the mudmats should exhibit lower fabrication costs than prior art mudmats. Finally, it would be desirable to provide mudmats that can be more easily fabricated and installed than prior art mudmats.

SUMMARY OF THE INVENTION

These and other objectives are achieved through a mudmat in which the bearing plates of the mudmat are fabricated of a non-corrosive, man-made structural material such as plastics. The plates, formed of such a material, are lightweight, easily fabricated and generally less expensive than the prior art plates and their associated support structure. In one preferred embodiment, the plates are formed of extruded polyvinyl chloride (PVC) or a fiber reinforced composite such as thermoset resin reinforced with glass fibers (GRP). The individual plates are supported by standard frame members. The PVC or GRP plates are of such a size, shape and weight that they can easily be assembled and attached to the offshore jacket at the jacket fabrication site. Being formed of such materials, the plates are corrosion resistant, eliminating the need for cathodic protection. In addition, the PVC or GRP plates are much lighter in weight than the wood or metal plates of the prior art, such that they have much less impact on the buoyancy and weight of the jackets to which they are attached. In one preferred embodiment, the plates are corrugated to increase their moment-carrying capacity and to better resist horizontal and vertical displacement forces imposed upon the offshore jacket during its installation phase.

DETAILED DESCRIPTION OF THE PREFERRED EMBODIMENTS

In the detailed description of the invention, like numerals are employed to designate like parts throughout. Various items of equipment, such as fasteners, fittings, etc., may be omitted to simplify the description. However, those skilled in the art will realize that such conventional equipment can be employed as desired.

Figure 1:
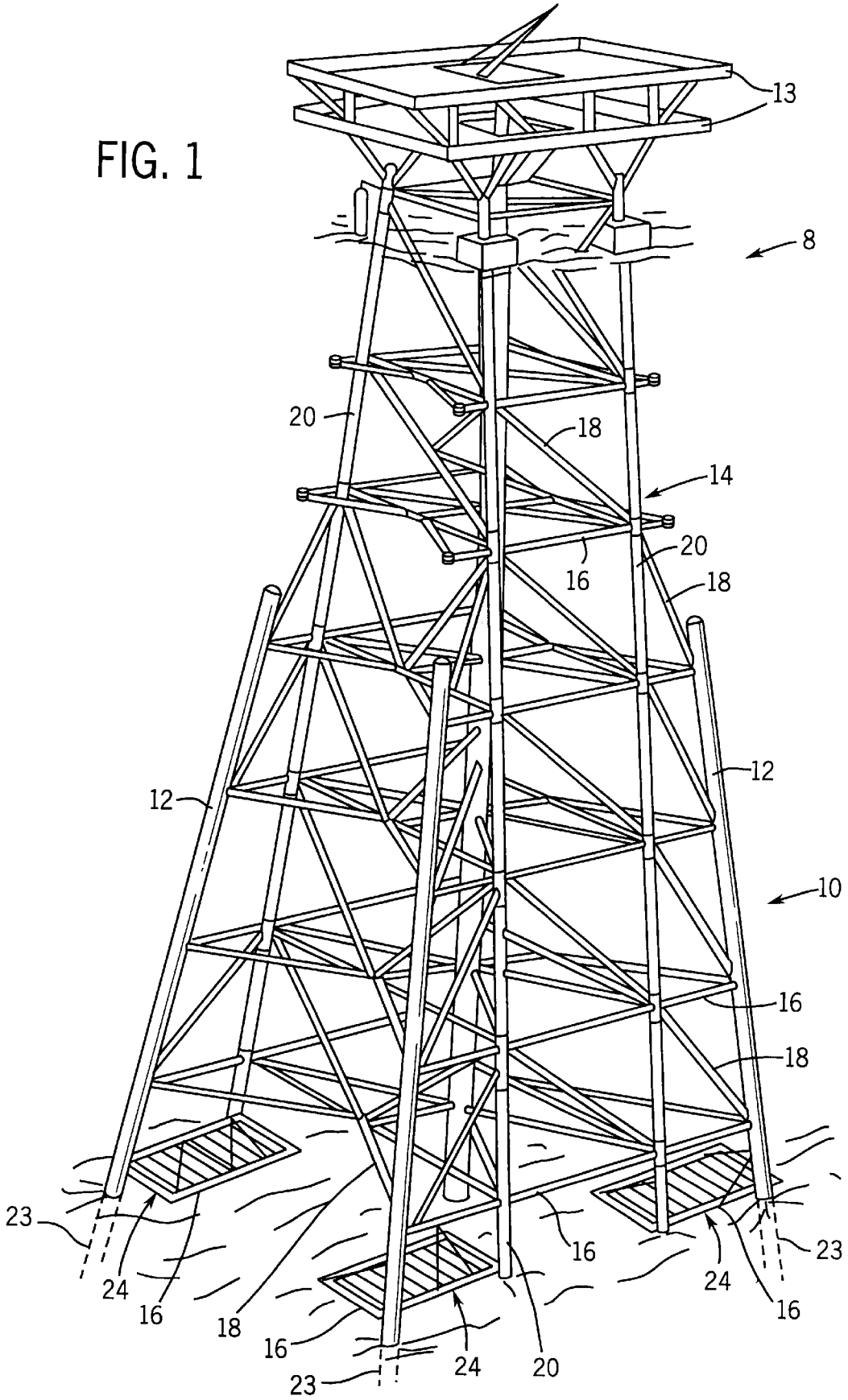
FIG. 1 is a perspective view of a vertically oriented jacket outfitted with mudmats adjacent each leg.

With reference to FIG. 1, a perspective view of an offshore platform 8 having a jacket 10 is shown. Jacket 10 includes corner legs 12 and jacket framing 14. Jacket framing 14 generally consists of generally horizontal members 16, diagonal members 18 and substantially vertical members 20, all of which provide lateral support for legs 12 and horizontal support for a deck 13. Attached to each leg 12 are one or more pile sleeves (not shown) for receipt of piles 23 which are driven deeply into the sea floor to secure jacket 10 thereon. After the pile driving operations have been completed, the piles are permanently affixed to the interior of legs 12 or pile sleeves using any standard method, such as cementing or welding.

Figure 2:
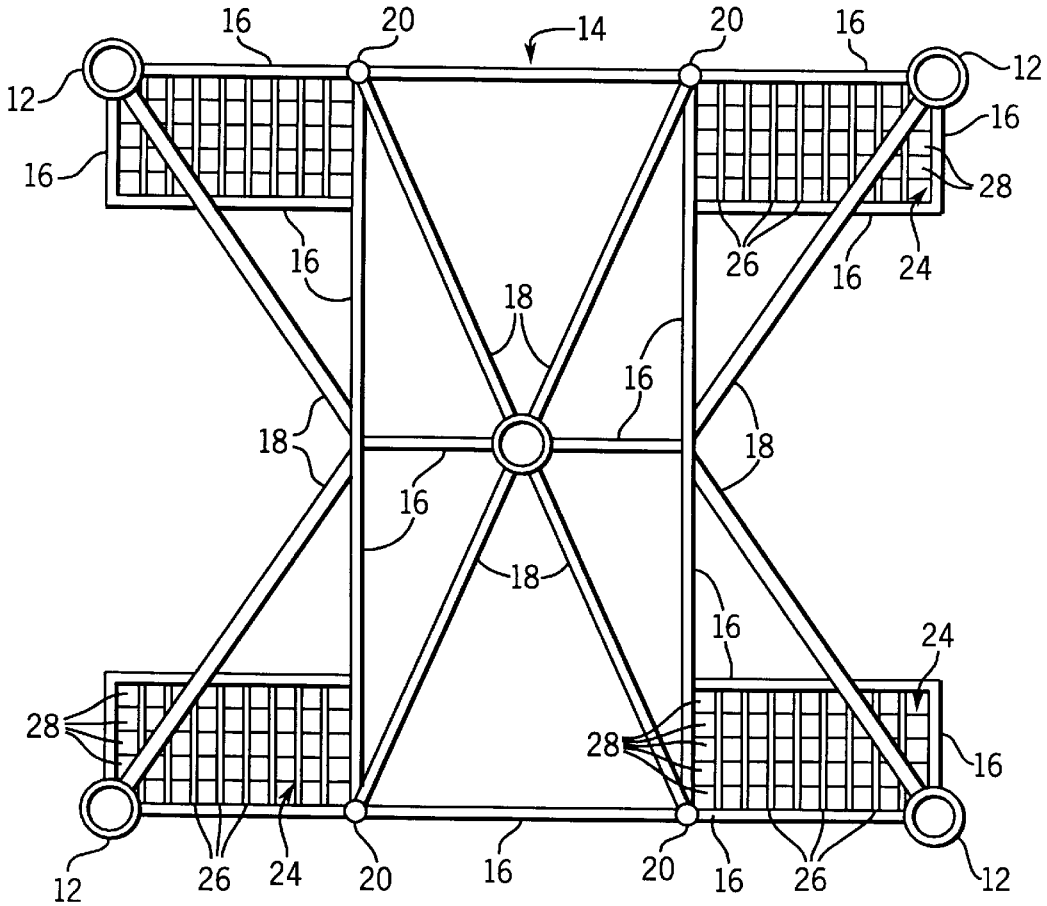
FIG. 2 is a plan view of the lowermost level of the jacket of FIG. 1, showing the position of the mudmats in relation to the legs and framing of the jacket.
Figure 3:
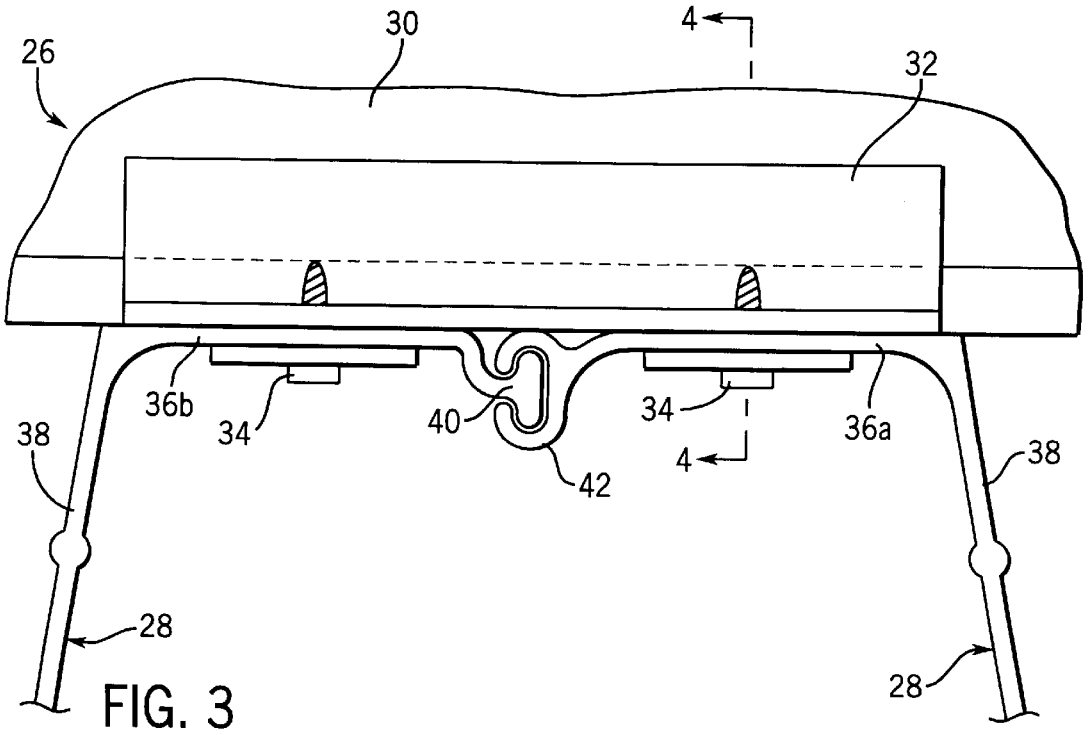
FIG. 3 is side view of mudmat plates shown attached to one another and to the mudmat support framing.
Figure 4:
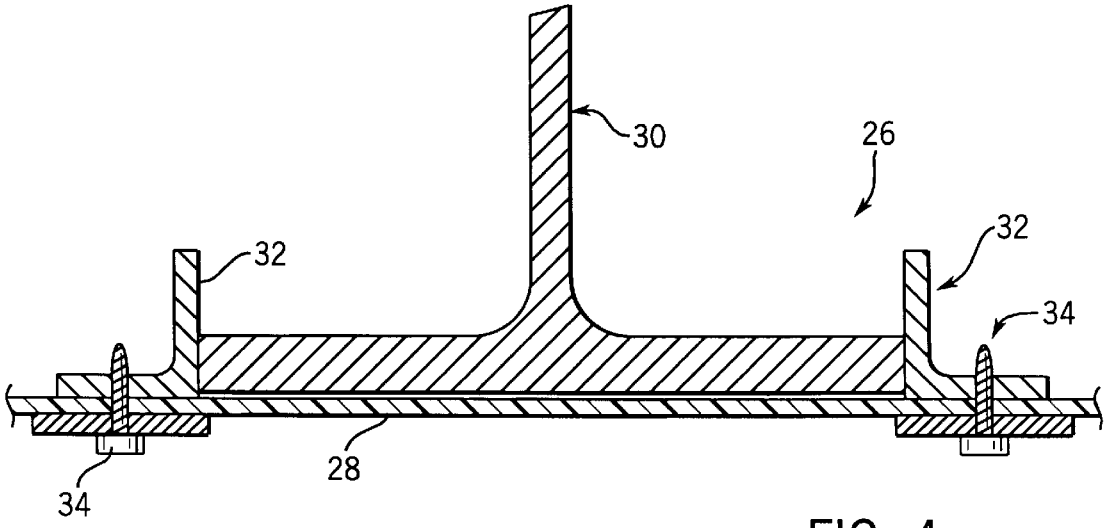
FIG. 4 is a partial cross-sectional view of a plate of FIG. 3, illustrating one possible means of attachment of a plate to the mudmat support framing.

Located near the bottom of each jacket leg 12 are mudmats 24. With reference to FIGS. 2 and 3, each mudmat 24 generally comprises a support structure 26 to which is attached a plurality of plates or bearing plates 28. In one embodiment, support structure 26, best shown is FIG. 4, is comprised of a plate girder 30 to which is attached angle iron 32 at each end of the plate girder. Plate 28 is shown attached to angle iron 32 using any standard fastener 34, such as by way of example only, a self-tapping screw. In this particular embodiment, plate girder 30 provides backing support to plate 28. However, due to the substantial cross-sectional thickness of plate girder 30, plate girder 30 is not readily disposed for receipt of fastener 34. Therefore, to enhance ease of fabrication, angle iron 32, which has a smaller cross-sectional thickness than plate girder 30, is utilized as the point at which plate 28 is attached to support structure 26. Returning to FIG. 2, support structure 26 is attached to jacket 10 by way of jacket framing 14. Specifically in FIGS. 1 and 2, there is shown a plurality of plate girders 30 attached to and extending between horizontal members 16.

Figure 5:
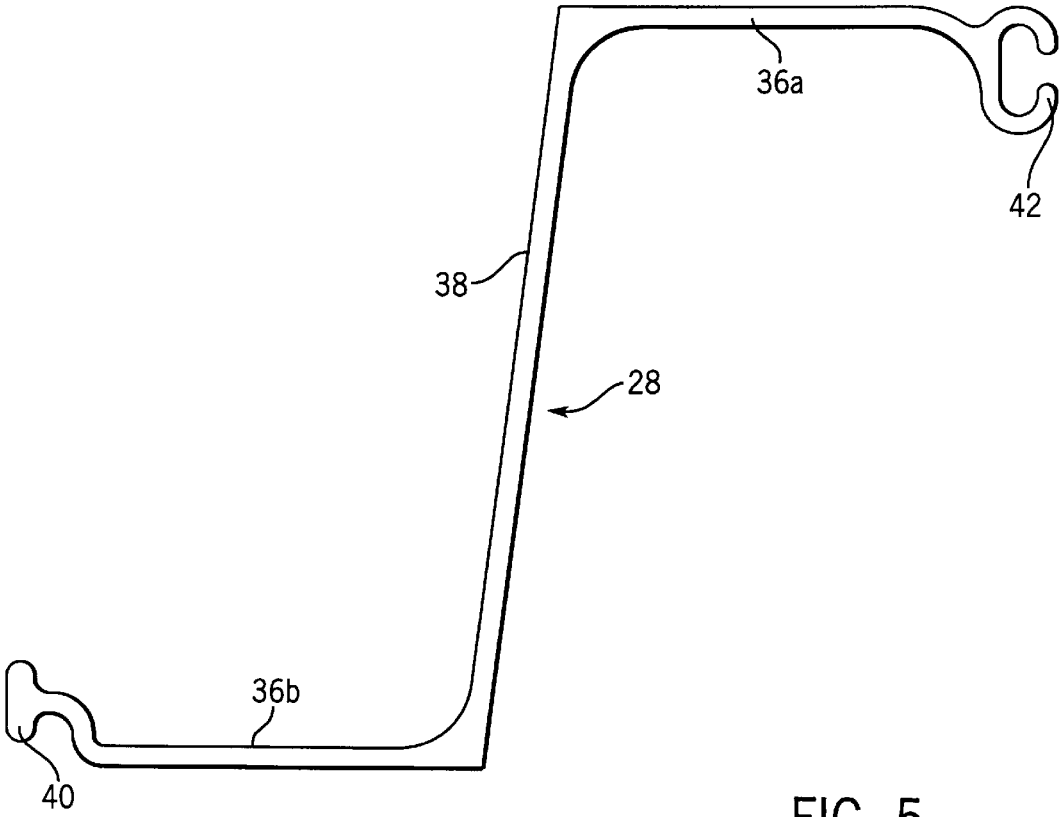
FIG. 5 is a side view of one embodiment of a single mudmat plate section.

Although plates 28 may have any shape without departing from the spirit of the invention, in one embodiment shown in FIGS. 3 and 5, each individual plate 28 is z-shaped (FIG. 5) such that when attached to one another, plates 28 form an overall corrugated mudmat surface (FIG. 3). In this embodiment, each plate is formed of first and second horizontal portion 36*a*, 36*b* and a substantially vertical portion at web 38 disposed therebetween. Each horizontal portion is provided with an attachment structure consisting of either a ball structure 40 or a socket structure 42 for attaching a first horizontal portion 36*a* of one plate to a second horizontal portion 36*b* of an adjacent plate. Again, the plates may be joined together using any standard manner, however, it has been found that the "snap-together" design of the ball and socket configuration further enhances ease of manufacture. In any event, when adjacent plates are joined in this manner to form a corrugated mudmat surface, mudmat 24 provides both lateral and vertical support to jacket 10. Specifically, when disposed on an unconsolidated or soft sea floor, mudmat 24 "settles" into the sea floor such that vertical portions 38 extend down into the sea floor, forming a shallow foundation for jacket 10. Of course, plates 28 need not be z-shaped, but may be of any design, such as for example, flat or sculpted, to have any particular shape that might be desirable for a specific sea floor. Furthermore, such plates may be disposed for attachment anywhere on jacket 10 or its related structure, and can be of any configuration necessary for a particular function, such as for example, rectangular or triangular.

The novelty of the instant invention lies in the materials of construction. Heretofore, prior art mudmats, and specifically their horizontal base plates, have been fabricated of either wood or metal, exhibiting the numerous drawbacks addressed above. The plates 28 of the instant invention are fabricated of a non-corrosive, man-made structural material such as plastic. Plates 28, formed of such a material, are lightweight, easily fabricated and generally less expensive than the prior art plates. In addition, being lighter in weight than prior art plates, plates 28 require less support structure, which therefore diminished the overall weight of mudmat 26 when compared to the prior art. In one preferred embodiment, plates 28 are formed of extruded polyvinyl chloride (PVC) or a fiber reinforced composite such as thermoset resin reinforced with glass fibers (GRP). Such plates weigh approximately 3.5–6.0 pounds per square foot in air and approximately 1.5–3.0 pounds per square foot in water, such that both in and out of the water, plates 28 weigh less than the plates of the prior art. Those skilled in the art will understand that plates 28 may be formed of any type of man-made plastic material without departing from the invention. In any event, such plastic materials are much more easily, and less expensively, formed into a shape desired for a particular purpose than prior art plates fabricated of wood or metal. Thus, the plates of the invention also provide a flexibility in design that the prior art plates do not. One plastic material that has been found to be particularly suitable for the invention is #1 grade PVC.

The mudmat of the invention provides a lightweight offshore jacket support system that is easily fabricated, transported, installed and maintained. The mudmat plates are corrosion resistant, eliminating the need for cathodic protection so common in the industry at present. In addition, the plates provide design flexibility over prior art plates such that the plates of the invention can be more easily sculpted to meet specific use criteria.

While certain features and embodiments of the invention have been described in detail herein, it will be readily understood that the invention encompasses all modifications and enhancements within the scope and spirit of the following claims.

What is claimed is:

1. A mudmat for support of an offshore structure, said mudmat comprising:

a. at least one soil-bearing plate; and b. framing members which are attached to and provide support to said at least one bearing plate, c. wherein said bearing plate is formed of plastics.

2. The mudmat of claim 1, wherein said bearing plate is formed of polyvinyl chloride.

3. The mudmat of claim 1, wherein said bearing plate is formed of a particle reinforced resin.

4. The mudmat of claim 3, wherein said particle reinforced resin is thermoset resin reinforced with glass fibers.

5. The mudmat of claim 1, wherein said bearing plate is substantially flat.

6. A mudmat for support of an offshore structure, said mudmat comprising:

a. at least one soil-bearing plate; and b. framing members which are attached to and provide support to said at least one bearing plate, c. wherein said bearing plate is formed of plastics, and d. wherein said bearing plate is corrugated.

7. The mudmat of claim 6, wherein said bearing plate comprises a. a first bearing plate; and b. a second bearing plate.

8. The mudmat of claim 7, wherein said first and second bearing plates are attached to one another with a web.

9. The mudmat of claim 8, wherein said first bearing plate is provided with a socket structure and said second bearing plate is provided with a ball structure and said ball structure seats within said socket structure to attach said plates.

10. A mudmat for support of an offshore structure, said mudmat comprising:

a. a first and a second bearing plate attached to one another, wherein said first bearing plate is provided with a socket structure and said second bearing plate is provided with a ball structure and said ball structure seats within said socket structure to attach said plates to form a corrugated plate surface;

b. framing members which are attached to and provide support to said at least one bearing plate, said framing members comprising a bearing plate support structure, said support structure comprising (1) a plate girder means, and (2) at least one plate attachment flange attached to said plate girder means, (3) wherein at least one of first and second bearing plates is attached to said plate attachment flange; and c. wherein said bearing plates are formed of plastic.

11. The mudmat of claim 10, wherein said bearing plates are formed of polyvinyl chloride.

12. The mudmat of claim 10, wherein said bearing plates are formed of a particle reinforced resin.

* * * * *